US005683011A

United States Patent [19]

Miliani

[11] Patent Number: 5,683,011

[45] Date of Patent: Nov. 4, 1997

[54] DEVICE FOR DOSING AND DISPENSING SOLID SUBSTANCES

[76] Inventor: Rachid Miliani, Kimwierde 363, NL-1353 ER Almere, Netherlands

[21] Appl. No.: 666,935

[22] Filed: Jun. 19, 1996

[30] Foreign Application Priority Data

Jun. 20, 1995 [NL] Netherlands ..... 1000603

[51] Int. Cl.[6] ..... B67D 5/08

[52] U.S. Cl. ..... 222/56; 222/370; 222/146.6; 141/351; 141/361

[58] Field of Search ..... 222/55, 56, 77, 222/333, 346, 370, 61, 63, 64, 146.6; 141/351, 361, 360

[56] References Cited

U.S. PATENT DOCUMENTS

| | | | |
|---|---|---|---|
| 3,075,363 | 1/1963 | Conto . | |
| 3,207,366 | 9/1965 | Feistel, Jr. . | |
| 4,083,462 | 4/1978 | Teske et al. . | |
| 4,123,918 | 11/1978 | Kohl et al. . | |
| 4,386,640 | 6/1983 | Carr et al. | 141/361 |
| 4,496,087 | 1/1985 | Marks | 141/361 |
| 4,528,848 | 7/1985 | Hafner | 222/77 |
| 4,930,685 | 6/1990 | Landers | 222/370 |
| 5,405,052 | 4/1995 | Sawyer, III | 222/64 |

*Primary Examiner*—Philippe Derakshani
*Attorney, Agent, or Firm*—Banner & Witcoff, Ltd.

[57] ABSTRACT

The present invention relates to a device for dosing and dispensing solid substances such as ice, which device is provided with at least one storage chamber, at least one discharge opening, at least one movable feed element which is arranged between the storage chamber and the discharge opening and has at least one receiving space, and a structure for dosing the quantity of solid substance to be dispensed through the discharge opening. A solid substance, such as ice, can hereby be dosed and dispensed quickly and hygienically. A suitable choice of the volume of the storage chamber in relation to the adjusted quantity of solid substance for dispensing ensures an uninterrupted operation of the device.

13 Claims, 1 Drawing Sheet

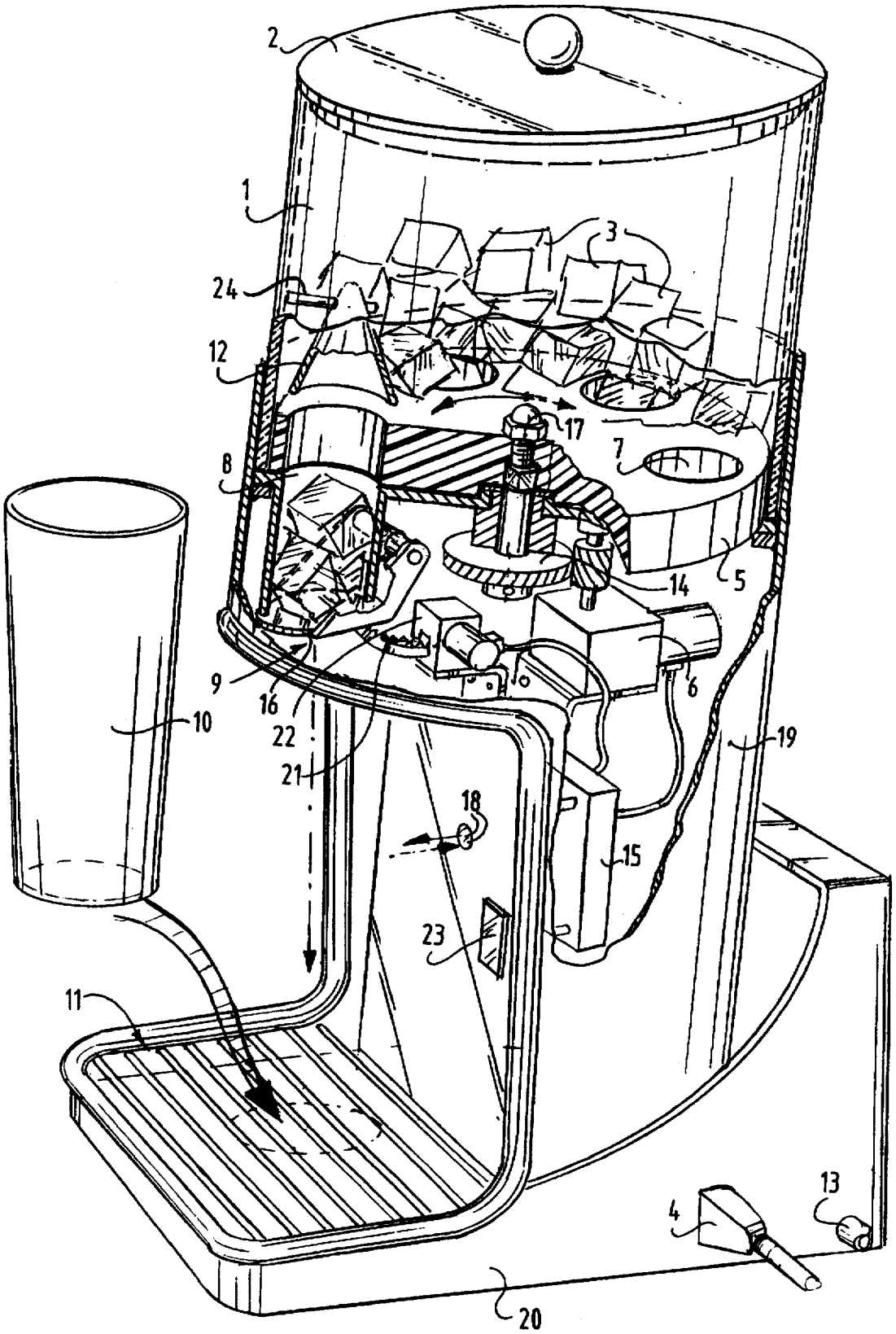
2
1
3
24
12
17
7
8
5
14
9
16
22
21
6
10
19
18
15
23
11
13
4
20

DEVICE FOR DOSING AND DISPENSING SOLID SUBSTANCES

FIELD OF THE INVENTION

The present invention relates to a device for dosing and dispensing solid substances such as ice.

BACKGROUND OF THE INVENTION

In practice the dispensing of solid substances such as ice is usually performed manually. Envisaged here are the many catering establishments where the ice is located in a cool box and from which, if required for instance necessary for cooling a drink, a determined quantity of ice is dosed and delivered by hand into a drink recipient such as a glass. This however causes hygienic problems, while moreover the quantity of dispensed solid substance is always different.

Devices are already known for batch dispensing of ice, for instance from U.S. Pat. No. 5,117,654, in which a device is described which is provided with a screw conveyor arranged in a cylinder. Such devices operate slowly however and have too small a capacity, while the quantity for dispensing often varies. In addition, these devices are large and difficult to operate so that they are not advantageous for a user such as a barman.

SUMMARY OF THE INVENTION

The present invention has for its object to obviate the above mentioned drawbacks and provides for this purpose a device which is provided with at least one storage chamber, at least one discharge opening, at least one movable feed element which is arranged between the storage chamber and the discharge opening and has at least one receiving space, and means for dosing the quantity of solid substance to be dispensed through the discharge opening. A solid substance such as ice can hereby be dosed and dispensed quickly and hygienically. A suitable choice of the volume of the storage chamber in relation to the adjusted quantity of solid substance for dispensing ensures an uninterrupted operation of the device.

Preferred embodiments of the device according to the invention are described in the dependent claims.

BRIEF DESCRIPTION OF THE DRAWINGS

The invention is further elucidated on the basis of a non-limitative embodiment wherein reference is made to the annexed FIGURE.

DETAILED DESCRIPTION OF THE INVENTION

The device comprises a storage chamber 1 closed off by a cover 2 in which is placed the solid substance 3, here for instant ice. Storage chamber I and cover 2 are usually manufactured from a material having insulating properties. Situated beneath the solid substances such as ice is a disc-shaped, rotatably disposed feed element 5 in which are provided receiving spaces 7. A shaft 17 of feed element 5 is connected via connecting elements 14 in the form of a gear transmission to a drive unit 6, such as a motor. A discharge opening 8 having roughly the same diameter as a receiving space 7 is situated under feed element 5. The discharge opening 8 is closed in the storage chamber 1 by a closing element 12. The closing element 12, which is in the shape of an inverted cone, is stationary, being fixed to the inner wall of the storage chamber 1 by pin 24. The function of closing element 12 is to close off the discharge opening 8 with a minimum friction for the dosed and dispensed rotating material.

The device further has means 9 for dosing the quantity of solid substances for dispensing through the discharge opening 8. These dosing means 9 comprise a dosing element 16 which is arranged under discharge opening 8 and which is movable between a position closing off the discharge opening 8 and a position leaving this opening clear. The dosing means 9 further comprise one or more sensors (not shown) for determining the weight and/or volume of solid substance in discharge opening 8. This sensor is connected for generating signals to an electronic circuit 15, which in turn is connected for control to the dosing element 16, here in the form of a pivotable dosing valve. In the embodiment shown the valve 16 is operated by a gear rack 21 which is driven by a motor 22 under the control of circuit 15. Other methods of operation, for instance by means of a solenoid and a biasing spring, are however also conceivable.

Provided beneath receiving space 7 is a placing station 11, on which inter alia a receptacle or breaker 10 can be placed. At the height of the receptacle placed on the placing station are provided one or more sensors 18 which are connected for control to the motor 22 and drive unit 6, likewise with interposing of the electronic circuit 15. A discharge line 13 provides drainage of excess material, for instance drink or melted water. The device is enclosed by a housing 19 with a foot 20 manufactured from a stainless steel or other material, for instance plastic. The foot 20 has a connection for plug 4, whereby the device is connected to an electricity source (not shown). The device can be switched on and off by means of a switch 23.

The operation of the device is as follows. After storage chamber 1 has been filled with a solid substance such as ice and the device has been switched on by operating the on/off switch 23, the drive unit 6 will cause the feed dement 5 to rotate in a determined direction. Due to the force of gravity the solid substance such as ice is carried via the receiving space 7 into the discharge opening 8, until the sensors arranged therein detect that a determined weight and/or volume has been reached. The electronic control circuit 15 then switches off the drive unit 6. At this moment the feed element is no longer rotating. If stagnation occurs between receiving space 7 and discharge opening 8 the direction of rotation is reversed for a predetermined time, likewise under the control of electronic circuit 15. If now a receptacle or glass 10 is detected on placing station 11 by the sensors 18, the dosing element 16 is then pivoted by the motor 22 under the control of circuit 15 to its position leaving clear the discharge opening 8 and the dosed quantity of solid substance such a ice is dispensed, whereafter the cycle can be repeated. The duration of a full cycle can amount to less than 1 second.

It can be seen herefrom that the device operates quickly and efficiently. The quantity of dispensed solid substance is always identical and since there is no longer any contact between the hands and the solid substance there is no risk of contaminating the solid substance such as ice. The overall dimensions of the device are roughly of the order of magnitude such that it can easily be placed on, for instance, a bar or sink unit.

Preferably, the device has, when placed on a horizontal surface, an inclined position. Because of this inclined position, melting water can easily be drained off.

The capacity of the device can be adapted simply to the requirement. For this purpose, the volume of the storage chamber 1 and/or the diameter of the receiving space 7 and/or the diameter of the discharge opening 8 can be adapted. Instead of a storage chamber, the device may also have combined therewith a supply preparation unit for solid substances such as ice.

I claim:

1. Device for dosing and dispensing solid substances (3), comprising at least one storage chamber (1), at least one discharge opening (8), at least one movable feed element (5) which is arranged between the storage chamber (1) and the discharge opening (8) and has at least one receiving space (7), and means (9) for dosing the quantity of solid substance to be dispensed through the discharge opening, said dosing means (9) comprising a dosing element (16) which is arranged under the discharge opening (8) and which is movable between a position closing off the discharge opening (8) and a position leaving said discharge opening (8) clear.

2. Device as claimed in claim 1, characterized in that the dosing means (9) are adapted to dispense a determined weight.

3. Device as claimed in claim 1, characterized in that the dosing means (9) are adapted to dispense a determined volume.

4. Device as claimed in claim 1, characterized in that the dosing element (16) is pivotable.

5. Device as claimed in claim 1, characterized in that the dosing element (16) is connected for control to electronic measuring sensors (15) in order to determine the quantity for dispensing.

6. Device as claimed in claim 1, characterized in that the feed element (5) is rotatable.

7. Device as claimed in claim 6, characterized in that the feed element (5) is rotatable in two directions.

8. Device as claimed in claim 6, characterized in that the feed element (5) is driven by a drive unit (6) via connecting elements (14).

9. Device as claimed in claim 1, characterized in that a sensor element (15) connected for control to the feed element is provided to control the operation of the device.

10. Device as claimed in claim 1, characterized in that the storage chamber (1) comprises a closing element (12) covering the discharge opening (8).

11. Device as claimed in claim 1, characterized in that the device has at least one discharge line (13) connected to the storage chamber (1).

12. Device as claimed in claim 1, characterized in that under the discharge opening (8) is arranged a placing station (11) which is likewise connected to the discharge line (13).

13. Device as claimed in claim 12, characterized in that the placing station is provided with a receptacle.

* * * * *